US005338281A

United States Patent [19]

Terranova

[11] Patent Number: 5,338,281

[45] Date of Patent: Aug. 16, 1994

[54] WICKET SERVO METHOD AND DEVICE IN A BAG MAKING MACHINE

[75] Inventor: Peter Terranova, Howard Beach, N.Y.

[73] Assignee: Ro-An Industries Corporation, Middle Village, N.Y.

[21] Appl. No.: 32,971

[22] Filed: Mar. 18, 1993

[51] Int. Cl.[5] ..... B31B 23/16; B31B 23/64; B31B 23/98

[52] U.S. Cl. ..... 493/28; 493/29; 493/204

[58] Field of Search ..... 493/1, 2, 3, 24–28, 493/29, 194, 195, 196, 204

[56] References Cited

U.S. PATENT DOCUMENTS

| | | | |
|---|---|---|---|
| 4,451,249 | 5/1984 | deBin | 493/204 |
| 4,693,701 | 9/1987 | deBin | 493/204 |
| 4,699,607 | 10/1987 | Lambrecht | 493/204 |
| 4,758,214 | 7/1988 | deBin | 493/204 |
| 4,796,499 | 1/1989 | Achelpohl | 493/204 |
| 5,000,727 | 3/1991 | Hatchell et al. | 493/204 |
| 5,002,522 | 3/1991 | Feustel | 493/1 |
| 5,094,656 | 3/1992 | Hatchell et al. | 493/193 |

FOREIGN PATENT DOCUMENTS

| | | | |
|---|---|---|---|
| 3937536 | 5/1990 | Fed. Rep. of Germany | 493/24 |
| 2059630 | 4/1981 | United Kingdom | 493/196 |
| 2221422 | 2/1990 | United Kingdom | 493/24 |

*Primary Examiner*—William E. Terrell
*Attorney, Agent, or Firm*—Steinberg, Raskin & Davidson

[57] ABSTRACT

This invention relates to a method and device for manufacturing plastic bags by transversely cutting and sealing a plastic web at spaced locations and, more particularly, to a method and device for operating a stacking device by means of a servo-motor. The servo-motor is coupled to a conveyor on which a plurality of pin stack elements are arranged. The servo-motor is also connected to a servo-controller which directs the operation of the servo-motor and coordinates the movement of the conveyor with the movement of a pair of draw rolls which draw the web through a cutting and sealing bar which forms individual bags. The bags are carried from the area of their formation by means of a wicketer to the pin stack elements on the conveyor. The servo-controller directs the draw rolls to cease drawing the web to prevent waste of bag production so that an arm of the wicketer, which will pass over the conveyor when the conveyor is being moved, does not carry a bag. The present invention also relates to a method for modifying an existing bag making machine by removing an independent motor coupled to the conveyor and installing a servo-motor connected to a servo-controller.

19 Claims, 3 Drawing Sheets

WICKET SERVO METHOD AND DEVICE IN A BAG MAKING MACHINE

BACKGROUND OF THE INVENTION

The invention relates to a method and device for manufacturing plastic bags by transversely cutting and sealing a plastic web at spaced locations and, more particularly, to a method and device for operating a stacking device by means of a servo-motor.

The invention further relates to a method for modifying an existing bag making machine by coupling a servo-motor to the stacking device and controlling the operation of the servo-motor by means of a servo-controller.

Certain types of plastic bags are typically manufactured by drawing a tubular plastic web from a supply roll and then cutting and sealing the web transversely at spaced locations to form bags of a standard length. The formed bags are then carried by a vacuum arm assembly to a stacking device.

In the stacking device, the bags are stacked on a set of pins mounted on mobile elements, such as wicketing stands, which are attached to a conveyor. The vacuum arm assembly brings the bags being formed by a cutting and sealing bar or blade onto the pins of the stacking element in the wicketer station until a certain desired amount of bags on each element is reached. Once the desired amount of bags is reached, the "full" stacking element is moved away from the wicketer station and a new empty set of pins is brought into position whereby bags will be deposited on the set of pins on this new, empty stacking element. This procedure is repeated every time the index of the number of bags being stacked on the element positioned in the wicketer station reaches the desired amount.

In prior art devices, the pin stacking elements are arranged on a conveyor belt so that only one element is in the wicketer station at a time, and in such a position is capable of receiving bags from the vacuum arm assembly. As the element fills up with bags and reaches the desired pre-set amount, it is moved away from the wicketer station and a second element is rotated on the conveyor into the position formerly occupied by the first so that the bags will begin to accumulate on the second pin stack element. In this manner, a series of pin stack elements will be filled up with bags whereby each element has the same amount of bags.

In prior art devices having a conveyor-type system, there is a substantial amount of time required to replace a full pin stack element with an empty pin stack element. During this interval of time, the plastic web cannot be drawn. As a result, the plastic web does not advance through the bag machine to the cutting and sealing blade and bags are not formed. This avoids unnecessary production and then, consequently, a waste of bags production as the pin stack element will not be in place in the wicketer station to receive any of the bags being formed. The production of bags recommences once the empty pin stack element is in a locked position in the wicketer station. During this time, the vacuum arm assembly is rotating and, therefore, several arms will be void of bags. Generally, the movement of the conveyor requires a stoppage of bag production for an interval of time such that three arms of a typical six-arm vacuum assembly will be devoid of bags.

It is a drawback of prior art devices that the operating speed of the bag making machine is partly limited by the time factor needed for the full pin stack element to be replaced by an empty pin stack element so that the bags being produced will always be carried onto a receiving set of pins on an empty pin stack element. As the production of bags ceases during the replacement time, this results in a significant reduction in the utilization and optimization of the machine.

The amount of time for which the production of bags will cease while the conveyor moves the pin stack elements is a function of the production speed of the bag making machine. For example, if the speed of the machine is about 200 bags/minute, the machine would be required to interrupt production for at least two cycles, i.e. skip two bags, so that the pin stack element could be rotated by the conveyor. At a speed of about 300 bags/minute, a total of three machine interrupts, i.e. skipping three bags, would be required. Each interrupt translates into lost production which over the span of an hour, or even a day, is a significant amount of wasted and inefficient use of the bag making machine.

By way of example, if the desired number of bags on the pin stack element is 250 bags, the machine will interrupt for two cycles and direct the draw rolls to cease drawing the web every time the pin stack element is switched. Assuming the machine were running at an operating speed of about 300 bags/minute, the conveyor would index about 72 times. In other words, the conveyor would have to move the pin stack element 72 times in the span of one hour. Each time the pin stack element is moved, there is a stoppage of bag production and the optimization of the machine is decreased.

Moreover, the amount of interrupts of the bag machine is a function of the speed of the bag production by the machine. If the speed of production is 200 bags/minute, a total of two interrupts will be required when the plastic web will not be drawn and bags will not be cut by the cutting and sealing blade. During the time of these two interrupts, or time intervals, the conveyor will be moving the full pin stack element away from the wicketer station and bringing an empty pin stack element into the wicketer station to begin to receive bags. At a speed of 300 bags/minute, three interrupts will be required and three bags will not be produced which could have been produced by the machine. At this operating speed, a total of 216 bags (3 interrupts per switch of a pin stack element $\times$ 72 indexing times per hour) will not be produced in every hour of operation of the bag machine. During a typical 8 hour operation of the machine, the total of lost production will be 1,728 bags. This is an even more significant disadvantage when the operating times and speeds of the machine increases.

OBJECTS AND SUMMARY OF THE INVENTION

Accordingly, it is an object of the present invention to provide a new and improved bag making machine in which the drawbacks related to the prior art devices are substantially eliminated.

It is another object of the present invention to provide a method and device in a bag making machine in which a conveyor is connected to a series of pin stack elements and is driven by a servo-motor whose operation is coordinated with the bag production sequence.

It is yet another object of the present invention to increase the running speed of the bag making machine, and thereby the optimization and utilization of the machine.

It is still another object of the present invention to provide a device and method for modifying an existing bag making machine to increase the running speed and decrease the lost bag production.

It is still another object of the present invention to provide a method and device in which only one cycle interrupt is required to switch pin stack elements on the conveyor.

Briefly, in accordance with the present invention, these and other objects are attained by coupling a servo-motor to a conveyor on which a series of pin stack elements is mounted. The operation of this servo-motor is coordinated with the operation of an additional servo-motor which operates the draw rolls to provide for only a single interrupt in the bag production cycle for each switch of the pin stack element. The servo-motor operates at a higher speed to turn the conveyor and, therefore, the substitution of a full pin stack element for an empty pin stack element takes less time than in prior art devices. By decreasing the amount of time required for the conveyor to switch pin stack elements, a larger amount of bags are produced as compared to prior art devices in the same amount of time and running at the same operating speed.

In the method of the present invention, a tubular plastic web is drawn through a pair of draw rolls to a cutting and sealing bar or blade which forms individual bags by cutting and sealing the plastic web. The bags which are formed are then conveyed to a first pin stack element on a bag stacking mechanism. The bag stacking mechanism has a plurality of pin stack elements which are connected for movement on an endless belt-type conveyor such that one of the pin stack elements is always in a position to receive the bags being placed on the bag stacking mechanism. The conveyor is coupled to a first servo-motor and the amount of bags on the pin stack element is continuously counted by means of a counting device. The conveyor is moved by means of the servo-motor when a desired number of bags on the pin stack element is reached. In this manner, a first, full pin stack element is moved and a second, empty pin stack element on the conveyor is brought into its place to receive bags.

In a preferred embodiment of the present invention, the draw rolls are connected to an additional servo-motor and the operation of the draw rolls is controlled by this additional servo-motor so that the draw rolls cease drawing the web when the conveyor is being moved. The amount of time the draw rolls interrupt the drawing of the web can be regulated to be substantially equal to the amount of time required for the conveyor to switch pin stack elements, i.e. move a full one away and bring a second empty one into position to receive bags. In addition, the servo-motors can be connected to a servo-controller which directs the operation of the bag making machine and coordinates the movement of the draw rolls to the movement of the conveyor. The desired number of bags on each of the pin stack elements can be entered into the servo-controller.

In use, when a clear plastic web is used to make the bags, the desired length of each of the bags can be entered into the servo-controller and the cutting and sealing blade can be connected to the servo-controller. In this manner, the cutting and sealing blade will cut and seal the edges of the bags to form bags of the desired length.

In another preferred embodiment, the bags are placed on the pin stack element by means of a multi-arm wicketer. The arms of the wicketer are provided with suction means to cause the bags to adhere to the arms. The wicketer is rotated in order to carry the bags from the area of their formation after the cutting and sealing blade to the pin stack element in the wicketer station. The rotation of the wicketer can be regulated via the servo-controller such that an arm of the wicketer, passing through the wicketer station, does not carry a bag when the conveyor is being moved.

In the device of the present invention, a pair of draw rolls define a nip and draw a tubular plastic web through the nip. A cutting and sealing bar or blade is arranged after the draw rolls in a running direction of the machine. The blade forms individual bags by cutting and sealing the plastic web at a desired length. A wicketer is arranged after the blade in the running direction of the machine and is provided with a plurality of arms which receive and carry the cut bags to a bag stacking mechanism. The bag stacking mechanism has a plurality of pin stack elements which are connected for movement on an endless belt-type conveyor. One of the pin stack elements is always arranged in a position to receive the bags from the wicketer, i.e. in the wicketer station. Importantly, a servo-motor is coupled to the bag stacking mechanism and moves the conveyor when the desired number of bags have been placed on the pin stack element in the wicketer station by the wicketer. In this manner, a second pin stack element will be moved into a position to receive bags from the wicketer.

In a preferred embodiment of the device of the present invention, the bag machine is provided with an additional servo-motor coupled to the draw rolls and a servo-controller connected to both servo-motors. The servo-controller controls the operation of the draw rolls and the conveyor such that the draw rolls cease drawing the web for a certain amount of time corresponding to the time the conveyor is being moved. The draw rolls will cease drawing the web before the conveyor is moved because of the delay caused by the time it takes for the wicketer to carry the bags to the pin stack element on the conveyor. Preferably, a timer is arranged in the servo-controller for regulating the amount of time the draw rolls cease drawing the web so that it is substantially equal to the amount of time required for the conveyor to switch pin stack elements. The desired number of bags on each pin stack element may be set by means of an input device connected to the servo-controller.

In the present invention, the single interrupt in the bag production cycle per switch of the pin stack element greatly decreases the amount of lost bag production. In comparison with prior art devices, at an operating speed of about 300 bags/minute and a desired stack of 250 bags on the pin stack element, there will only be 72 interrupts resulting in a lost production of only 72 bags per hour, a reduction of 66.66% when compared with prior art devices wherein there are three interrupts, or cycles, of lost bag production for every movement of the conveyor carrying the pin stack elements. In other words, there is an increase in production of 144 bags per hour which achieved by coupling a servo-motor to the pin stack element conveyor.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
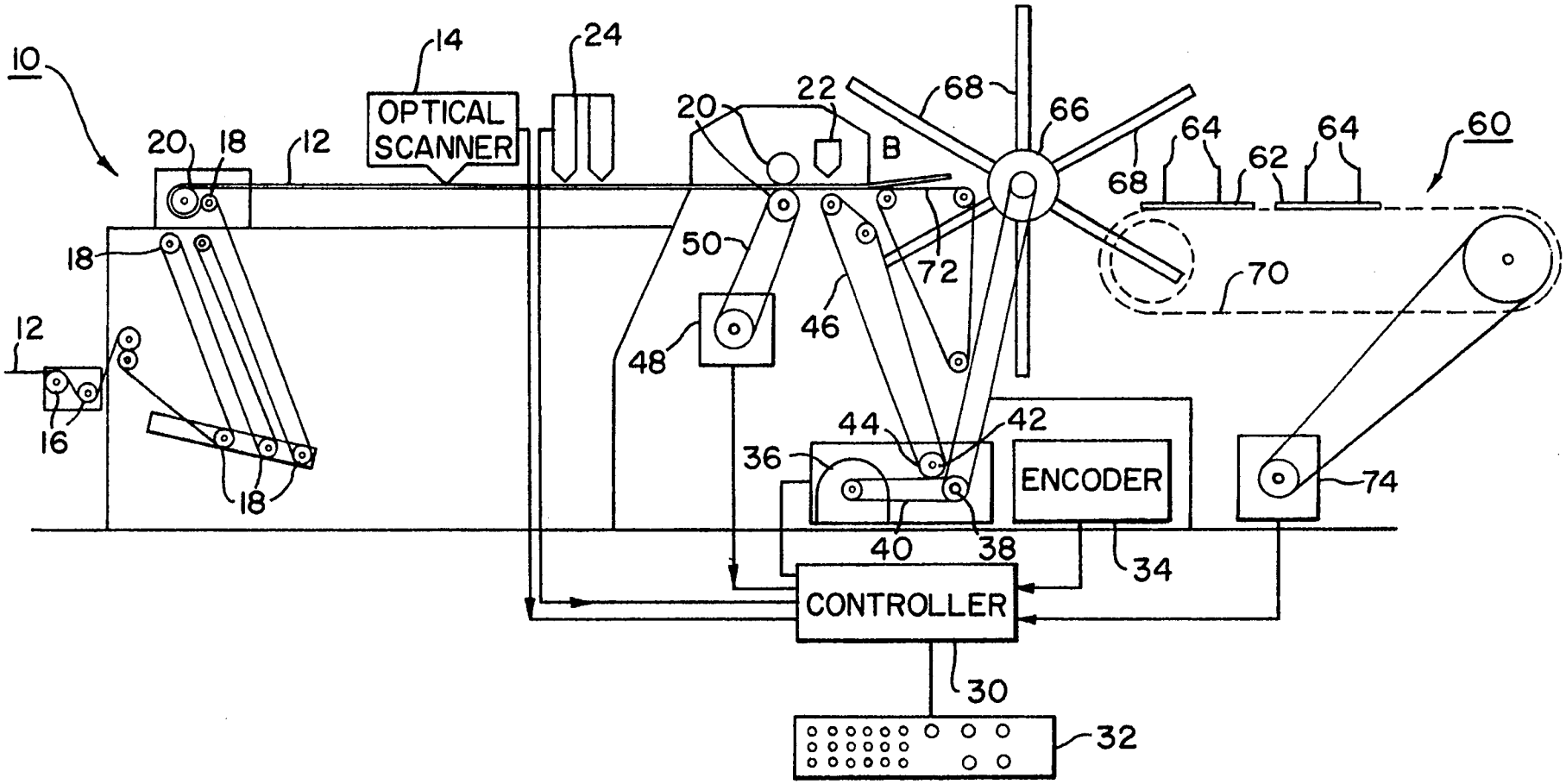
FIG. 1 is a schematic diagram of a bag making machine incorporating the device of the present invention and used in a method in accordance with the present invention.

Referring to FIG. 1, a bag machine 10 for making plastic bags from a continuous tubular web 12 of plastic material in accordance with the invention is illustrated. The web 12 is drawn from a supply roll (not shown) and is advanced forward through a pair of infeed rollers 16, a plurality of idler rollers 18, and then between a pair of draw rolls 20. Idler rollers 18 maintain a supply of the web 12 to the draw rolls 20 under a substantially constant tension. A transverse cutting and sealing bar or blade 22 is positioned after the draw rolls 20 in the running direction of the machine. The bar 22 is mounted for reciprocation to cut and seal the web 12 after each web index movement to form individual bags. Preferably, the draw rolls 20 are active for one half a cycle, i.e. 180°, in a preprogrammed drawing pattern so that the bar 22 is activated to form individual bags during the remaining 180° of the cycle.

The bag machine 10 may include an optical scanner for scanning marks on the plastic web, such as eyemarks, and a hole punch device 24 for punching holes in the plastic web 12. The device 10 also includes a controller 30, a control panel 32 by which an operator can input information to the controller 30, an encoder 34 and a servo-motor 48 for controlling the draw rolls 20. The servo-motor 48 operates the draw rolls via belt 50. The bag machine further includes a main drive motor 36 which drives a main drive shaft 38 by means of a belt 40. The reciprocation of the cutting and sealing bar 22 is accomplished by means of a conventional mechanism (not shown) driven by the main drive shaft 38 through gears 42 and 44, and belt 46. The encoder 34 is coupled to and receives a position-indicating output from the main drive shaft 38 which drives the cutting and sealing bar 22 and is operable to provide a signal to controller 30 indicative of the rotational position of main shaft 38 and, in turn, the position of the cutting and sealing bar 22.

The controller 30, e.g. servo-controller, is coupled to and controls the operation of the servo-motor 48 which drives the draw rolls 20 by means of a belt 50. The servo-controller 30 also controls and coordinates the operation of the optical scanner 14 and the hole punching device 24.

A vacuum arm assembly 66 is arranged after the cutting and sealing bar 22 in the running direction of the machine. The vacuum arm 66 typically comprises a wicketer having a plurality of arms 68, usually 6, and is driven by the main drive motor 36 via the main drive shaft 38. The arms 68 of the vacuum arm assembly 66 picks up bags B that have been formed by the cutting and sealing bar 22 and which are momentarily placed on a set of pulleys 72. The arm assembly rotates to place the bags carried thereon on a pin stack mechanism 60.

The pin stack mechanism 60 comprises a conveyor 70 having a number of pin stack elements 62, or wicket stands, each having a set of pins 64 on which the bags are placed by the vacuum arm assembly 66. In use, bags are picked up by the arms 68 of the arm assembly 66, one bag per arm, and rotated onto a pin stack element 62 which is placed in a wicketer station. The wicketer station is defined as the position of a pin stack element 62 on the conveyor 70 such that holes formed by the hole punching device 24 in the individual bags will be align with the set of pins 64. The arms 68 are connected to a source of negative pressure to provide suction for the bags to adhere to the arms 68 while being carried to the pin stack element 62 in the wicketer station.

The conveyor 70 is an endless conveyor to which the pin stack elements 62 are mounted. The bags are removed from the wicket stands 62 at some point between the arms 68 and the end of the bag making machine. A servo-motor 74 is coupled to the conveyor 70 by means of a gear 76 to drive the conveyor 70 and thus move the pin stack elements to and from the wicketer station. The operation of the servo-motor 74 is coordinated with the controller 30 so that the conveyor 70 will be moved when a desired amount of bags have been placed on the pin stack element in the wicketer station. When the conveyor 70 is moved, a new empty pin stack element will be placed in the wicketer station to thereby be filled up with bags. This switch of pin stack elements 62 is repeated every time the desired number of bags have been placed on the pin stack elements 62.

The controller is preferably a type of servo-controller and its operation is as follows. The amount of bags desired on each pin stack element is selected and programmed into the controller 30 by means of the control panel 32. The amount may be changed during the operation of the bag machine. The controller 30 receives information from the encoder 34 as to the actual position of the cutting and sealing bar 22. The controller 30 also sends a signal to the draw rolls 20 to start drawing the plastic web 12 in a synchronized manner with the cutting and sealing bar 22 to initiate the cutting and sealing of edges of the web 12 to form bags B. As discussed previously, the draw rolls 20 preferably operate in a half-cycle arrangement, i.e. 180°, while the cutting bar 22 operates for the remainder of the cycle, 180° in a preprogrammed mode of operation.

In a preferred embodiment, the servo-controller 30 may also comprise regulating means arranged therein for regulating the rotation of the wicketer 66. In this embodiment, one of the arms 68 of the wicketer 66 will not carry a bag onto a pin stack element 62 when the conveyor 70 is moved. This is because a bag has not been formed and passed to the arm 68 of the wicketer 66 during the rotation of the arms past the cutting and sealing bar 22. The movement of the wicketer 66 may also be controlled via the servo-controller 30 which receives information, i.e. a signal, from the encoder 34 and sends such signal to the wicketer 66.

During the usual operation of the machine, a bag is formed and then picked up from the set of pulleys 72 to be carried to the pin stack element 62 in the wicketer station. The controller 30 starts to index the amount of bags that have been formed by any number of methods, such as counting the number of operation of the draw rolls 20 or the cutting and sealing bar 22. Once the amount of bags formed equals the desired number of bags on each pin stack element, the controller interrupts the operation of the draw rolls 20 for one interrupt cycle. In other words, the draw rolls are idle for one complete cycle of 360° and do not draw the plastic web 12. In this manner, a bag is not formed. However, as the arm assembly 66 is constantly rotating, one of the arms 68 will not pick up a bag. Thereafter, the controller 30 will send a signal to the draw rolls 20 to begin drawing again.

After the desired number of bags have been formed, the last bag, as an example say a 200 bag count on the pin stack element is desired so the last bag would be the 200th, is still being carried on the vacuum arm assembly 66 to the pin stack element 62. On a typical 6 arm vacuum arm assembly, there will be a path of about 180° between the formation of the bag and its depositing on the pin stack element 62. Once the 200th bag is deposited on the pin stack element, the controller will signal the servo motor of the conveyor to turn the conveyor and move the full pin stack element away from the wicketer station so that a new empty pin stack element will be in place. This interval of movement of the conveyor 70 will preferably correspond to the time that the arm which is not carrying a bag passes through the wicketer station. Thus, there is no bag which will interfere in the movement of the pin stack elements 62 through the wicketer station nor will there be any waste of a bag.

Figure 2A:
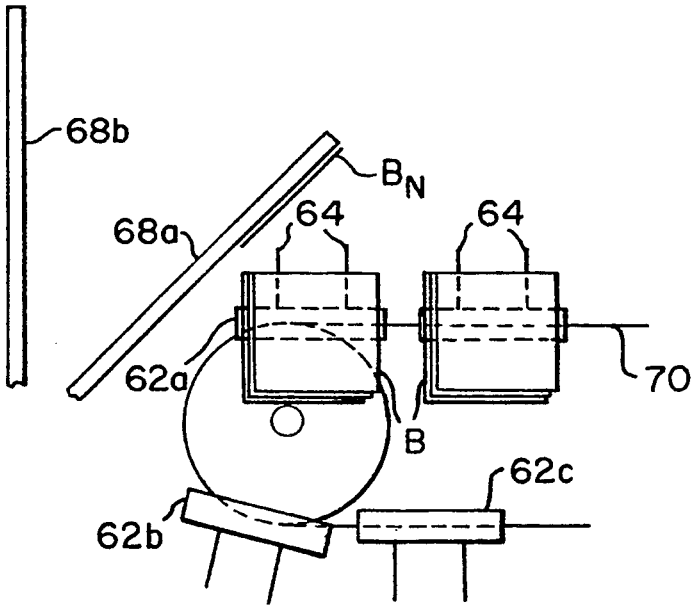
FIGS. 2A–2C illustrate the switching operation of the pin stack elements in accordance with the present invention.
Figure 2B:
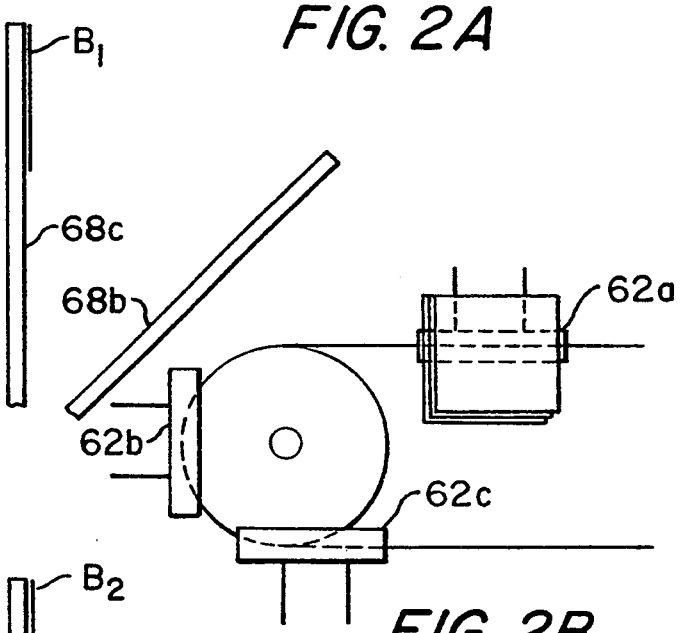
Figure 2C:
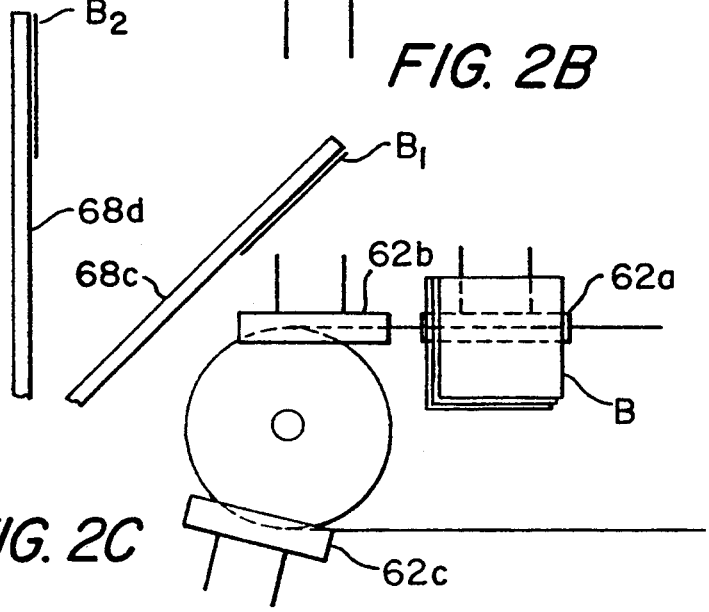

Referring to FIGS. 2A–2C, the process of the switching of the pin stack elements is illustrated. A wicketer arm 68*a* carries the last bag $B_N$ to be placed on a pin stack element 62*a*. Immediately following element 62*a* are additional empty elements 62*b*,62*c* on the conveyor 70. In accordance with the invention, one wicketer arm 68*b* will not carry a bag as one was not formed because the servo-controller 30 directed the draw rolls 20 to stop drawing for one cycle. As soon as the last bag $B_N$ is placed on element 62*a*, the servo-controller 30 will direct the servo-motor 74 to move the conveyor 70. Element 62*a* will be shifted away from the wicketer station and element 62*b* will be moved into the position occupied by element 62*a*. As shown in FIG. 2B, this movement of the conveyor will preferably coincide with the passage of arm 68*b* through the wicketer station.

Thereafter, the arm 68*c* following the empty arm 68*b* will carry a bag onto element 62*b* which is now in the wicketer station and capable of receiving bags. The servo-controller 30 coordinates the interrupt in production so that the empty wicketer arm 68*b* will pass through the wicketer station when the conveyor 70 is engaged in moving the pin stack elements. The draw rolls 20 will recommence drawing the web 12 and the wicketer 68 will then carry bags $B_1$,$B_2$, . . . , to the empty element 62*b* until such time as element 62*b* is filled with the desired number of bags.

Figure 3:
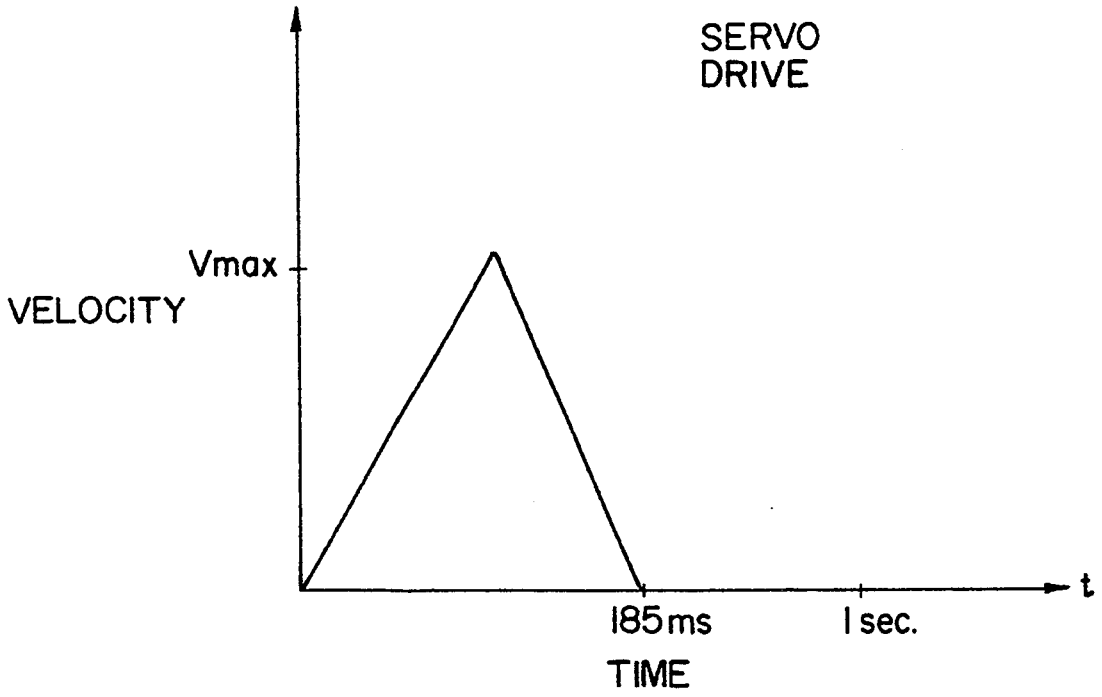
FIG. 3 is a graphical description of the velocity of the servo motor coupled to the pin stack element conveyor as a function of time in accordance with the present invention.

FIG. 3 is a graphical representation of the velocity of the servo-motor coupled to the pin stack element conveyor as a function of time. The velocity increases sharply to a maximum point and then decreases to zero in the time span of about 185 ms. Immediately after the velocity of the servo-motor stops, the pin stack element is locked into place and ready to receive the next count of bags. The increase and decrease of movement of the servo-motor 74, and thus the conveyor 70, in this relatively short span of time is a significant advantage as the speed of the wicketer 66 and draw rolls 20 can be almost freely increased so that the overall running speed of the machine is increased.

This short span of time translates into only one revolution of the wicketer 66 in which an arm of the wicketer does not carry a bag. Thus, the bag making machine 10 of the present invention can reach speeds of about 375 bags/minute.

Figure 4:
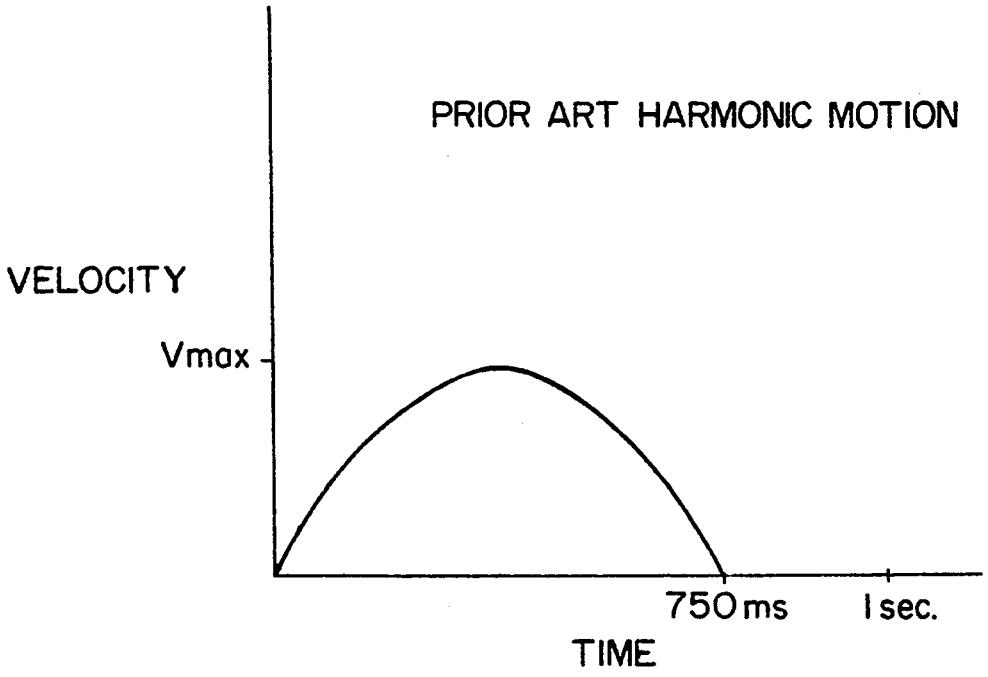
FIG. 4 is a graphical description of the velocity curve of a prior art device used to turn the pin stack element conveyor as a function of time.

FIG. 4 shows the velocity curve of a prior art device used to turn the pin stack element conveyor as a function of time. The indexing of the pin stack element is controlled by a four (4) position indexing table using Harmonic motion. The time elapsed for a transfer of the pin stack element through the wicketer station is about 750 ms, much greater that the amount of time required if a servo-motor is used in accordance with the present invention. This results in the need for two, three or even more interrupts in the cycle of bag production depending on the operating speed of the machine. When these interrupts are added together over an hour of production, a substantially large amount of production is lost.

The invention has been described above wherein there is only one interrupt in the cycle of production so that only one wicketer arm will not carry a bag and also during the passing of this arm through the wicketer station, the conveyor will be moved. However, the device in accordance with the present invention can be programmed via the servo-controller 30 to provide for two or more interrupts if desired. Although an increase in the amount of interrupts will decrease the rate of bag production, in certain uses it may be preferable to provide for multiple interrupts, e.g. as a result of a limit on the manual input necessary to operate the machine.

The present invention also relates to a method for modifying existing bag making machines. In this situation, a typical bag making machine that might be modified would include a wicketer, servo-motor connected to the draw rolls and a servo-controller. The conveyor on which the pin stack elements are mounted is usually driven by an independent motor. The improvement would thereby comprise coupling a servo-motor to the conveyor and connecting the servo-motor to the servo-controller so that the servo-controller will direct and coordinate the operation of the servo-motor connected to the conveyor and also the servo-motor connected to the draw rolls in the manner described above.

The examples provided above are not meant to be exclusive. Many other variations of the present invention would be obvious to those skilled in the art, and are contemplated to be within the scope of the appended claims.

I claim:

1. A method for stacking plastic bags in a plastic bag making machine, comprising the steps of drawing a tubular plastic web through a pair of draw rolls, forming individual bags by cutting and sealing the plastic web via a cutting and sealing blade, providing bag stacking mechanism with a plurality of pin stack elements connected for movement on an endless belt-type conveyor such that a first one of said pin stack elements is in a position to receive the bags being placed on said bag stacking mechanism, carrying the bags to said first pin stack element on said bag stacking mechanism, coupling said conveyor to a first servo-motor, indexing the number of bags on said first pin stack element, connecting said draw rolls to a second servo-motor and controlling the operation of said draw rolls via said second servo-motor, providing a servo-controller for monitoring the number of bags indexed on said first pin stack element and for sending a signal to said first and second servo-motors when the number of bag indexed on said first pin stack element reaches a predetermined number, said servo-controller being connected to said first servo-motor and said second servo-motor, moving said conveyor by means of said first servo-motor upon said servo-controller sending to said first servo-motor said signal such that said first pin stack element is moved and a second one of said pin stack elements on said conveyor is brought into its place, and coordinating the operation of said draw rolls via said second servo-motor with the movement of said conveyor via said first servo-motor by means of said servo-controller.

2. The method of claim 1, further comprising the steps of causing said draw rolls to cease drawing the web after the predetermined number of bags is produced, and regulating the amount of time said draw rolls cease drawing the web to be equal to or greater than the amount of time required for said second pin stack element to replace said first pin stack element.

3. The method of claim 1, further comprising the steps of entering the predetermined number of bags on each of said pin stack element into said servo-controller such that the servo-controller directs said first servo-motor to move said conveyor when the predetermined number of bags have been placed on each of said pin stack elements.

4. The method of claim 3, further comprising the steps of providing said tubular plastic web as a clear plastic web, and connecting said cutting and sealing blade to said servo-controller such that said cutting and sealing blade cuts and seals edges of the bags and forms bags of the desired length.

5. The method of claim 1, further comprising placing the bags on said pin stack element by means of a multi-arm wicketer, providing the arms of said wicketer with suction such that the bags adhere to the arms, and rotating said wicketer to carry the bags to said first pin stack element.

6. The method of claim 5, further comprising regulating the rotation of said wicketer via said servo-controller such that one of the arms of said wicketer does not carry a bag past said conveyor when said conveyor is moved.

7. The method of claim 1, wherein said first servo-motor controls the movement of said conveyor such that said conveyor moves at a substantially constant acceleration to a maximum velocity followed by a substantially constant deceleration to a rest position.

8. A device for stacking plastic bags in a plastic bag making machine having a running direction, comprising a pair of draw rolls defining a nip and arranged to draw a tubular plastic web through the nip, a cutting and sealing bar or blade arranged after said draw rolls in the running direction of the machine, said blade forming individual bags by cutting and sealing the plastic web at a desired length, a wicketer arranged after said blade in the running direction of the machine, said wicketer having arms which receive and carry cut bags, a bag stacking mechanism having a plurality of pin stack elements connected for movement on an endless belt-type conveyor, one of said pin stack elements being arranged in a position to receive the bags from said wicketer, a first servo-motor coupled to said bag stacking mechanism, a second servo-motor coupled to said draw rolls, and a servo-controller for monitoring the number of bags indexed on said one of said pin stack elements and for sending a signal to said first and second servo-motors when the number of bags indexed on said one of said pin stack elements reaches a predetermined number, said servo-controller being connected to said first servo-motor and said second servo-motor and coordinating the operation of said draw rolls via said second servo-motor with the movement of said conveyor via said first servo-motor said first servo-motor moving said conveyor upon said servo-controller sending to said first servo-motor said signal such that an additional one of said pin stack elements is moved into a position to receive bags from said wicketer.

9. The device of claim 8, further comprising a timer arranged in said servo-controller to regulate the amount of time said draw rolls cease drawing the web to be substantially equal to or greater than the amount of time required for said conveyor to move when the predetermined amount of bags have been placed on said one of said pin stack elements.

10. The device of claim 8, further comprising input means connected to said servo-controller for entering a predetermined number of bags on said one of said pin stack elements into said servo-controller such that said servo-controller directs said first servo-motor to move said conveyor when the desired number of bags have been placed on said one of said pin stack elements.

11. The device of claim 8, wherein said arms on said wicketer are provided with suction means to cause the cut bags to adhere to said arms and be carried to said one of said pin stack elements.

12. The device of claim 8, wherein said servo-controller comprises regulating means for regulating the rotation of said wicketer via said servo-controller such that one of the arms of said wicketer does carry a bag past said conveyor when said conveyor is moved.

13. The device of claim 8, wherein said first servo-motor controls the movement of said conveyor such that said conveyor moves at a substantially constant acceleration to a maximum velocity followed by a substantially constant deceleration to a rest position.

14. A method for modifying a plastic bag stacking arrangement in a plastic bag making machine having a rotatable main drive shaft for defining successive machine cycles, a pair of draw rolls for drawing a plastic web from a supply, a first servo-motor for controlling the operation of draw rolls, a servo-controller for controlling the operation of the first servo-motor, a conveyor driven by an independent motor for stacking the bags, a bag stacking device comprising a number of pin stack elements arranged on the conveyor, and a cutting and sealing bar for forming individual bags, comprising the steps of replacing the independent motor with a second servo-motor arranged to drive the conveyor, indexing the number of bags on a first one of the pin stack elements on the conveyor, said servo-controller monitoring the number of bags indexed on said first pin stack element and sending a signal to said first and second servo-motors when the number of bags indexed on said first pin stack element will reach a desired number, and moving the conveyor by means of the second servo-motor upon said servo-controller sending to said first servo-motor said signal such that the first pin stack element is moved and a second pin stack element on the bag stacking device is brought into its place, and controlling said second servo-motor via said servo-controller such that said servo-controller coordinates the draw rolls via said second servo-motor with the movement of said conveyor via said first servo-motor.

15. The method of claim 14, further comprising the step of causing the draw rolls to cease drawing the web when the predetermined amount of bags to be placed on the first pin stack element has been reached.

16. The method of claim 15, further comprising the step of regulating the amount of time the draw rolls cease drawing the web to be substantially equal to or greater than the amount of time required for the second pin stack element to replace the first pin stack element.

17. The method of claim 16, further comprising the steps of entering the desired number of bags of each of the pin stack element into the servo-controller to direct the servo-controller to send a signal to the second servo-motor to move the conveyor when the predetermined number of bags have been placed on the first pin stack elements.

18. The method of claim 17, further comprising the steps of providing the plastic web as a clear plastic web, inputing a desired length of each of the bags being producing in the bag making machine into the servo-controller, and connecting the cutting and sealing blade to the servo-controller such that the cutting and sealing blade cuts and seals edges of the bags and forms bags of the desired length.

19. The method of claim 14, wherein said first servo-motor controls the movement of said conveyor such that said conveyor moves at a substantially constant acceleration to a maximum velocity followed by a substantially constant deceleration to a rest position.

* * * * *